US011697899B1

(12) United States Patent
Martelli et al.

(10) Patent No.: US 11,697,899 B1
(45) Date of Patent: Jul. 11, 2023

(54) THREAD TENSION APPARATUS AND METHOD

(71) Applicants: John D. Martelli, Pensacola, FL (US); Chris Beaty, Post Falls, ID (US)

(72) Inventors: John D. Martelli, Pensacola, FL (US); Chris Beaty, Post Falls, ID (US)

( * ) Notice: Subject to any disclaimer, the term of this patent is extended or adjusted under 35 U.S.C. 154(b) by 163 days.

(21) Appl. No.: 17/234,895

(22) Filed: Apr. 20, 2021

(51) Int. Cl.
*D05B 47/04* (2006.01)
*D05B 43/00* (2006.01)

(52) U.S. Cl.
CPC ..... *D05B 47/04* (2013.01); *D05B 43/00* (2013.01)

(58) Field of Classification Search
CPC ..... D05B 47/04; D05B 47/06; D05B 43/00; D05C 11/08; D05C 11/12
See application file for complete search history.

(56) References Cited

U.S. PATENT DOCUMENTS 3,713,605 A * 1/1973 Vahle ..... D05B 43/00 242/157 R
2002/0035956 A1* 3/2002 Hori ..... D05C 11/16 112/293
2010/0147989 A1* 6/2010 Fukao ..... B65H 54/12 242/484.7
2018/0010275 A1* 1/2018 Fujihara ..... D05B 47/00
2022/0275552 A1* 9/2022 Takamura ..... D05B 59/00

FOREIGN PATENT DOCUMENTS

EP 1683901 A1 * 7/2006 ..... D05B 47/00

* cited by examiner

*Primary Examiner* — Alissa L Hoey
*Assistant Examiner* — Patrick J. Lynch
(74) *Attorney, Agent, or Firm* — J. Nevin Shaffer, Jr.

(57) ABSTRACT

A thread tension apparatus and method consists of a thread cone holder configured to hold thread where the thread cone holder is connected to a motor. A thread guide is provided where the thread guide includes a thread channel such that the thread guide directs thread to a machine where the machine draws thread in first direction. A motor controller is connected with the motor, where the motor controller operates the motor to turn the thread cone holder such that thread is drawn in a second direction opposite from the machine first direction such that tension is applied to the thread as thread is drawn to the machine.

20 Claims, 5 Drawing Sheets

THREAD TENSION APPARATUS AND METHOD

FIELD OF THE INVENTION

This invention relates to a thread tension system. In particular, in accordance with one embodiment, the invention relates to a thread tension apparatus with a thread cone holder configured to hold thread where the thread cone holder is connected to a motor. A thread guide is provided where the thread guide includes a thread channel such that the thread guide directs thread to a machine where the machine draws thread in a first direction. A motor controller is connected with the motor, where the motor controller operates the motor to turn the thread cone holder such that thread is drawn in a second direction opposite from the machine first direction such that tension is applied to the thread as thread is drawn to the machine.

BACKGROUND OF THE INVENTION

A problem exists in with regard to controlling material as it is unloaded from a storage medium and used by another system. Sewing machines, for example only and not by limitation, combine thread from bobbins and thread from thread cones to stitch material together. The prior art includes simply placing a thread cone on a spindle and allowing the sewing machine to pull the thread from the thread cone. Because sewing machines operate a varying speeds, the speed of removal varies as well. This causes thread to hunch and tangle in most cases and results in use of prior art devices to add tension to thread during use. Known devices are mechanical, difficult to operate and set and are not easily adjustable, among other things.

Additionally, thread leaves thread cones at locations that travel up and down the cone as the thread is unwrapped. This results in the sewing machine receiving thread from a wide variety of, and ever changing, angles. This causes stitches to vary, sometimes in unacceptable ways.

Thus, there is a need in the art for a thread tension system that, in combination with a sewing machine, controls the delivery of thread to the sewing machine in predictable and easily adjustable ways.

Further there is a need for a thread tension system that reduces angular stress on thread as it is delivered to the sewing machine such that stitches are repeatable and regular.

It therefore is an object of this invention to provide a thread tension system that is easy to use, is adaptable to any machine and the is adjustable to accommodate varying machine and thread dimensions.

SUMMARY OF THE INVENTION

Accordingly, the thread tension apparatus and method of the present invention, according to one embodiment, includes a thread cone holder configured to hold thread where the thread cone holder is connected to a motor. A thread guide is provided where the thread guide includes a thread channel such that the thread guide directs thread to a machine where the machine draws thread in first direction. A motor controller is connected with the motor, where the motor controller operates the motor to turn the thread cone holder such that thread is drawn in a second direction opposite from the machine first direction such that tension is applied to the thread as thread s drawn to the machine.

All terms used herein are given their common meaning so that "machine" identifies and describes a machine, such as a sewing machine for example only, for joining material together with "thread". Thread may include fabric, plastic and metal material. Any type of machine and thread now known or hereafter developed is included with the scope of this invention.

"Thread cone" describes a device known in the art used for the storing thread and from which thread is removed in use. The "thread cone" is typically cone shaped with more thread material at the base of the cone and narrowing toward the top. Here, however, "thread cone holder" describes a holder for thread whether the thread is stored in a "cone shape" or not.

"Motor controller" describes a device for manipulating a motor in known ways such as on, off, increase speed and decrease speed, for example only and not by limitation. The controller of the present invention also describes common computing devices such that additional data concerning the operation of the motor are available as well such as time of operation, actual speed, remote, wireless operation, etc.

"Tension" describes the amount of the resistance to movement created by the machine using thread and pulling thread from the thread cone holder in one direction while the motor turns the thread cone holder in a second, opposite, direction.

In one aspect, the thread channel includes a vertical channel and a horizontal channel and the thread channel moves up and down within the thread guide in response to where thread is removed from the thread cone holder.

In another aspect, the motor controller operates the motor such that tension on the thread is increased or decreased.

In one aspect, the thread cone holder is adjustable in relation to the thread guide.

In another aspect, the thread guide includes a thread gate where the thread gate includes a pair of horizontal contacts between which thread from the thread cone holder is directed.

In one aspect, the thread guide further includes a pair of vertical contacts between which thread is directed in an "S" pattern.

In one aspect the thread guide includes:

a. a thread channel into which thread enters and from which thread exits such that thread is aligned with the thread channel as it exits the thread guide and where the thread channel moves up and down within the thread guide in response to where thread is removed from the thread cone holder;

b. a thread gate where the thread gate includes a pair of horizontal contacts between which thread from said thread holder is directed; and c. a pair of vertical contacts between which thread is directed in an "S" pattern.

In another aspect, the invention further includes a stand where the stand supports the thread cone holder, the thread guide, and the motor controller and where the stand is connected with a machine and where the stand includes a power source connected with the motor.

According to another embodiment, a sewing machine thread tension apparatus includes a thread cone holder connected to a motor and a thread guide where the thread guide includes a thread channel such that the thread guide directs thread to a sewing machine where the sewing machine draws thread in a first direction. A motor controller is connected with the motor, where the motor controller operates the motor to turn the thread cone holder such that thread is drawn in a second direction opposite from the sewing machine first direction such that tension is applied to the thread as thread is drawn o the sewing machine and where the motor controller operates the motor such that tension on the thread is increased or decreased.

In one aspect, the thread channel includes a vertical channel and a horizontal channel and where the thread channel moves up and down within the thread guide in response to where the thread is removed from the thread cone holder.

In another aspect, the thread cone holder is adjustable in relation to the thread guide.

In a further aspect, the thread guide includes a thread gate where the thread gate includes a pair of horizontal contacts between which thread from said thread cone holder is directed.

In one aspect, the thread guide further includes a pair of vertical contacts between which thread is directed in an "S" pattern.

In another aspect, the thread guide includes:

a. a thread channel into which thread enters and from which thread exits such that thread is aligned with the thread channel as it exits the thread guide and Where the thread channel moves up and down within the thread guide in response to where the thread is removed from the thread cone holder;

b. a thread gate where the thread gate includes a pair of horizontal contacts between which thread from said thread holder is directed; and c. a pair of vertical contacts between which thread is directed in an "S" pattern.

In one aspect, the invention further includes a stand where the stand supports the thread cone holder, the thread guide, and the motor controller and where the stand is connected with a sewing machine and where the stand includes a power source connected with the motor In one aspect, the invention further includes a thread cone containing thread where the thread cone is removably connected with the thread cone holder.

According to another embodiment, a sewing machine thread tension method consists of:

a. providing a thread cone holder configured to hold thread where the thread cone holder is connected to a motor; a thread guide where the thread guide includes a thread channel such that the thread guide directs thread to a sewing machine where the sewing machine draws thread in a first direction; and a motor controller connected with the motor, where the motor controller operates the motor to turn the thread cone holder such that thread is drawn in a second direction opposite from the sewing machine first direction such that tension is applied to the thread as thread is drawn to the sewing machine; and b. connecting thread from the thread cone holder to a sewing machine.

In one aspect, the motor controller operates the motor such that tension on the thread is increased or decreased.

In another aspect, the thread guide includes:

a. a thread channel into which thread enters and from which thread exits such that thread is aligned with the thread channel as it exits the thread guide and where the thread channel moves up and down within the thread guide in response to there the thread is removed from the thread cone holder;

b. a thread gate wherein the thread gate includes a pair of horizontal contacts between which thread from said thread holder is directed; and c. a pair of vertical contacts between which thread is directed in an "S" pattern.

DESCRIPTION OF DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
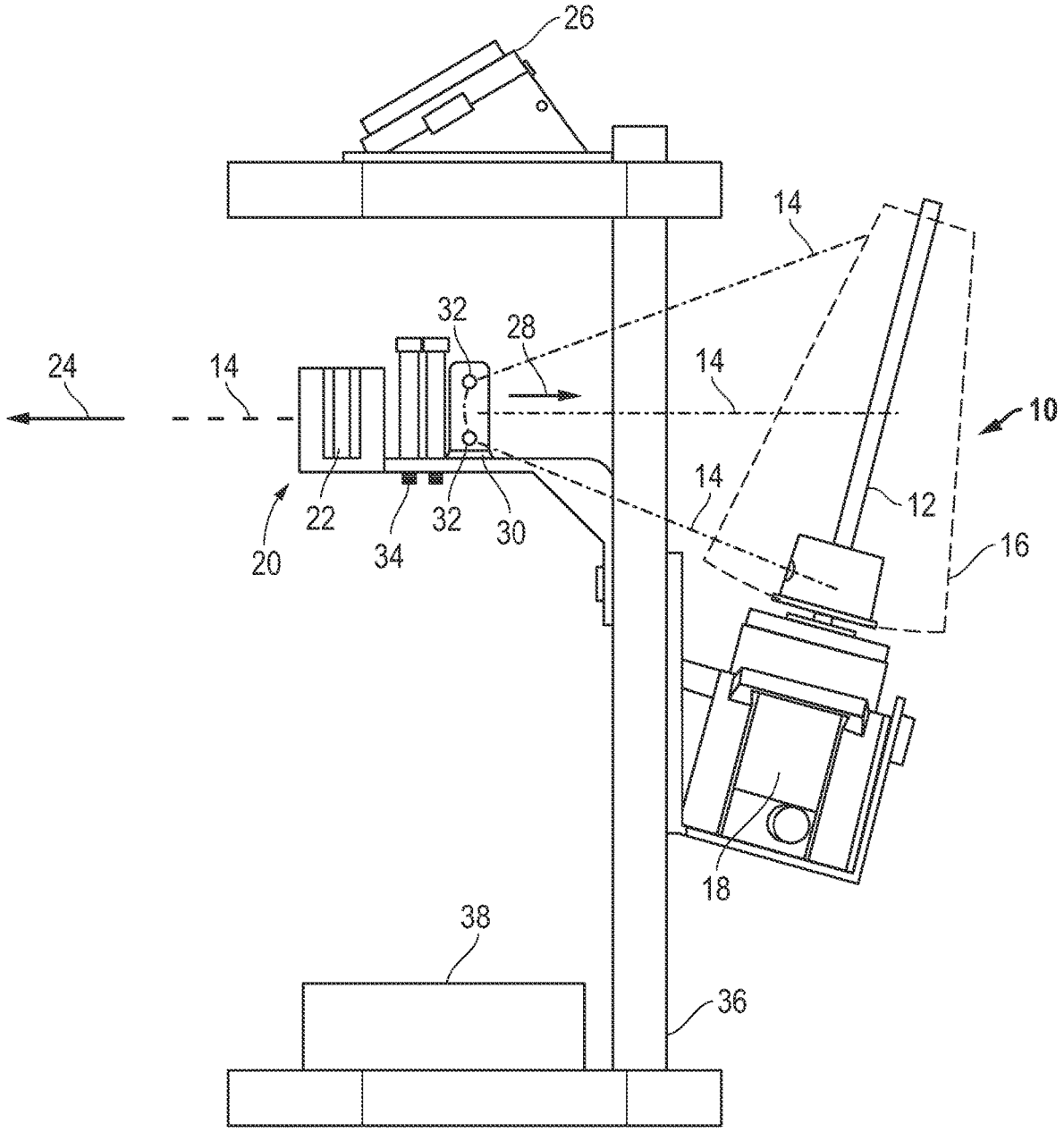
FIG. 1 is a side view of the thread tension apparatus of the present invention.
Figure 2:
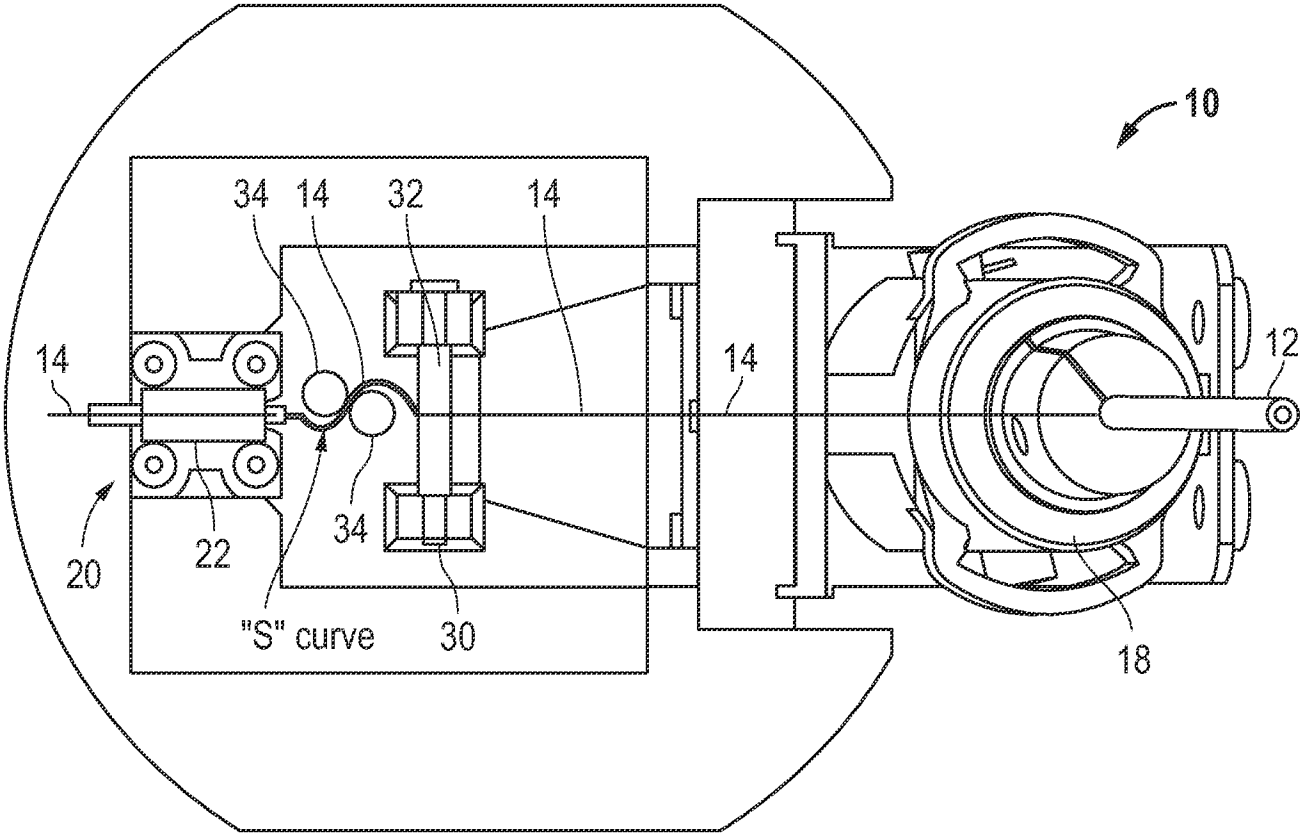
FIG. 2 is a top view of the invention of FIG. 1 showing the "S" curve of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

A preferred embodiment of the present invention is illustrated by way of example in FIGS. 1-5. With specific reference to FIG. 1, thread tension apparatus 10 includes a thread cone holder 12 configured to hold thread 14. Typically, in the art, thread 14 is wound for distribution in a manner which results in a cone shape 16, as shown in the dotted lines. As a result, thread 14 leaves thread cone holder 12 from a constantly moving location, traveling up and down the thread cone holder 12 as it is drawn to a machine, such as a sewing machine (not shown for clarity).

Thread cone holder 12 is connected to a motor 18. A thread guide 20 is provided where the thread guide 20 includes a thread channel 22 such that the thread guide 20 directs thread 14 to a machine (not shown) where the machine draws thread in a first direction as shown by direction arrow 24. A motor controller 26 is connected with the motor 18, where the motor controller 26 operates the motor 18 to turn the thread cone holder 12 such that thread 14 is drawn in a second direction shown by direction arrow 28 opposite from the machine first direction, direction arrow 24, such that tension is applied to the thread 14 as thread 14 is drawn to the machine. It should be clear that thread moves in the direction of direction arrow 24 toward the machine as thread 14 is used even though motor 18 is turning thread cone holder 12 in the opposite direction. Preferably, therefore, motor 18 is a motor, such as a DC motor for example only and not by limitation, that allows it to turn or rotate against the direction of rotation without damage. In one aspect, motor controller 26 operates the motor 18 such that tension on the thread 14 is increased or decreased as the user deems suitable.

In one aspect, the thread cone holder 12 is adjustable in relation to the thread guide 20. Again, as illustrated the typical cone shape of thread cones introduces sometimes sharp changes in the angle from which thread 14 is received by thread guide 20. One structure of the present invention is shown in FIG. 1 where thread cone holder 12 is shown angled away from vertical. This angle, in a preferred embodiment, is adjustable as desired.

In another aspect, the thread guide 20 includes a thread gate 30 where the thread gate 30 includes a pair of horizontal contacts 32 between which thread 14 from thread cone holder 12 is directed. In one aspect, the thread guide 20 further includes a pair of vertical contacts 34 between which thread 14 is directed in an "S" pattern, as more clearly seen in FIG. 2. In combination, thread 14 leaving thread cone holder 12 is funneled step by step along the way toward the machine. The thread gate 30 is the large end of the "funnel" directing thread 14 to a certain level by means of horizontal contacts 32. Next vertical contacts 34 aligned one in front of the other, add an "S" curve to the passage of thread 14 (See FIG. 2). This, Applicants have found, reduces pull on thread cone holder 12 and eases entry into thread channel 22.

Preferably, the present invention includes a support 36 to which all the elements are attached as shown in FIG. 1. Support 36 includes in one aspect a power source 38, such as a battery or power connection, for example only for both the motor controller 26 and motor 18. Also, it is to be understood that support 36 is configured for attachment with or near a sewing machine, for example, as a completely portable device.

Figure 3:
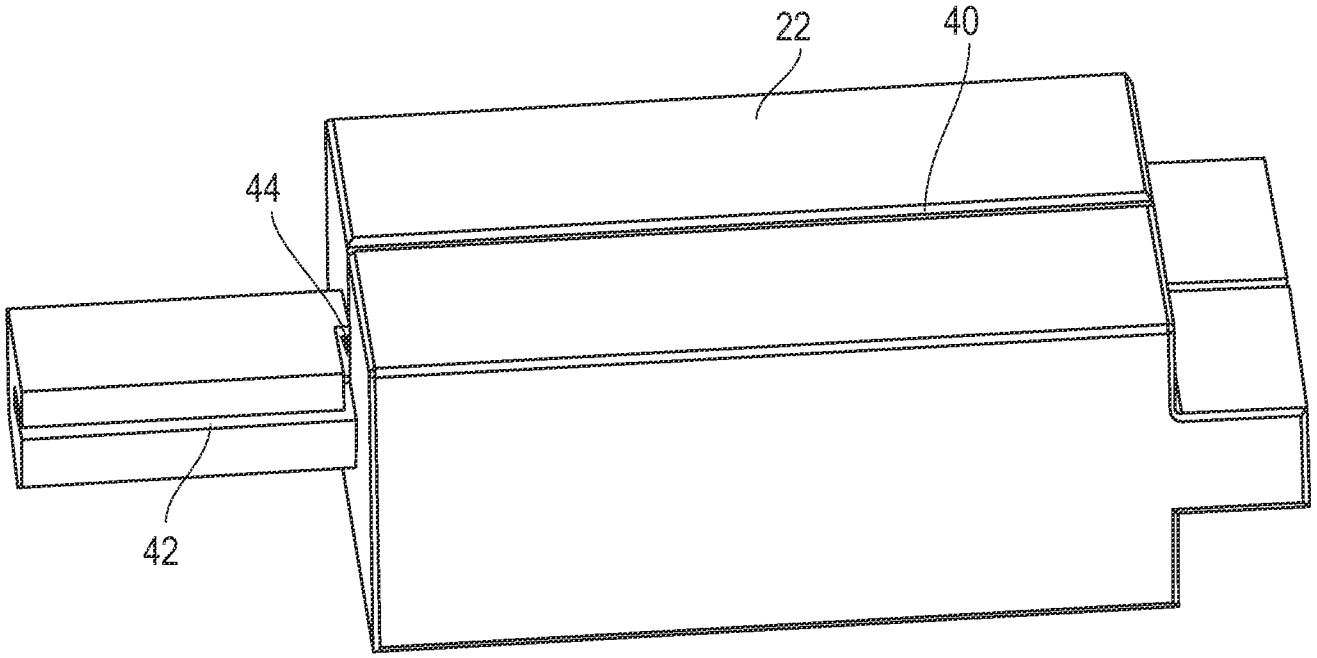
FIG. 3 is a close up perspective view of the thread channel of the invention of FIG. 1.
Figure 4:
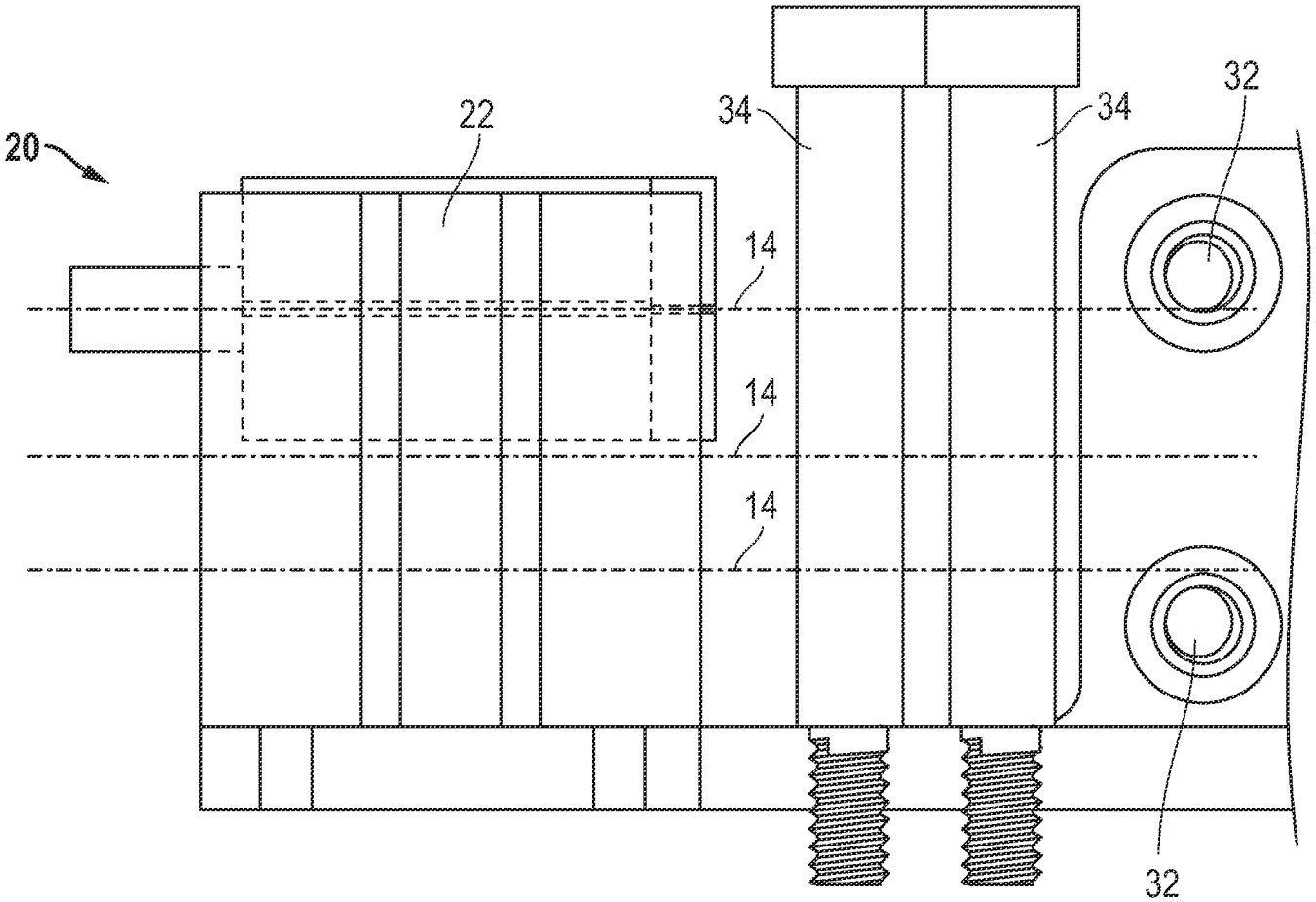
FIG. 4 is a close up side view of the thread guide, thread channel, thread gate and vertical contacts of the invention of FIG. 1.
Figure 5:
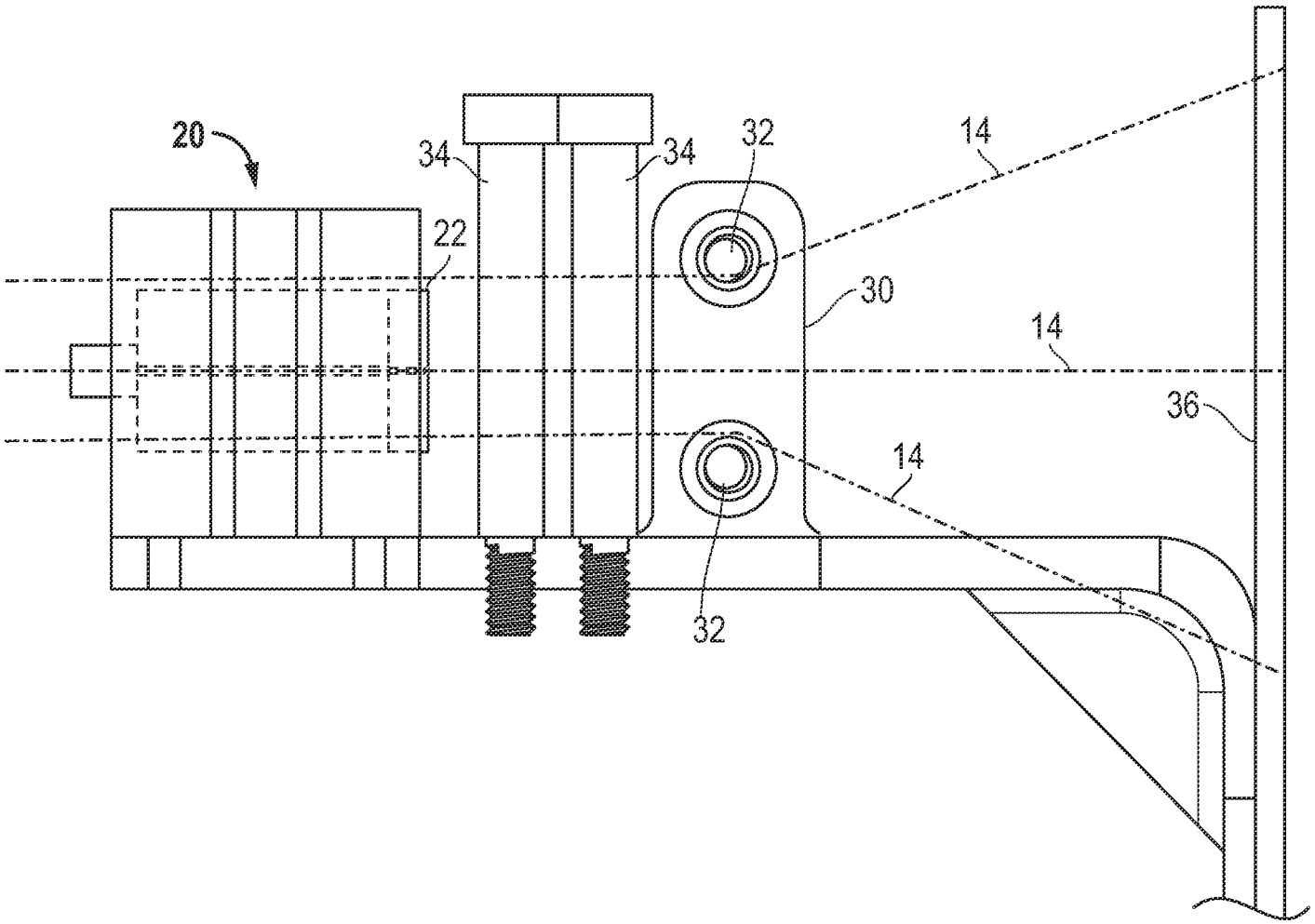
FIG. 5 is a side view of the invention of FIG. 4 showing the movement of the thread channel due to the angle of receipt of thread from the thread holder of the invention of FIG. 1.

Referring now to FIG. 3, in one aspect, the thread channel 22 includes a vertical channel 40 and a horizontal channel 42. The structure of this element of the present invention allows a user to simply, quickly and easily insert thread 14 into thread channel 22. Thread is placed into vertical channel 40 and drawn down to notch 44. Vertical channel 40 prevents movement of the thread horizontally. After notch 44 thread 12 is placed into horizontal channel 42 which prevents movement vertically. As a result, in this easy to perform manner, thread 12 is connected with thread channel 22 and, as a result, the thread channel 22 moves up and down within the thread guide 20 in response to where thread 14 is removed from the thread cone holder 12. This is illustrated by comparing FIGS. 4 and 5. In FIG. 4, thread 14 is coming off thread cone holder 12 at a high angle and thread channel 22 is at the top of thread guide 20 thus easing stress on thread 14. In FIG. 5, thread 14 is coming off thread cone holder 12 at a mid range and thread channel 22 moves to a center location in thread guide 20.

FIGS. 4 and 5 also show thread gate 30 and vertical contacts 34 which form the "S" curve in close up.

By way of further description, Applicants understand the invention to be most particularly useful where the machine is a sewing machine and the thread is a fabric thread. However, it should be understood that in any environment where one machine is pulling a "thread" in one direction and it is required to be a controlled pull under tension, that the principles and structures of the present invention will be uniquely useful, as with the laying of cable, for example only The description of the present embodiments of the invention has been for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A thread tension apparatus comprising:

(a) a thread cone holder configured to hold thread wherein the thread cone holder is connected to a motor;

(b) a thread guide wherein the thread guide includes a thread channel such that the thread guide directs the thread to a machine wherein the machine draws the thread in a first direction and wherein the thread channel includes a vertical channel and a horizontal channel and wherein the thread channel moves up and down within the threat guide in response to where the thread is removed from the thread cone holder; and (c) a motor controller connected with the motor, wherein the motor controller operates the motor to turn the thread cone holder such that the thread is drawn in a second direction opposite from the machine first direction such that tension is applied to the thread as the thread is drawn to the machine.

2. The apparatus of claim 1 wherein the motor controller operates the motor such that tension on the thread is increased or decreased.

3. The apparatus of claim 1 wherein the thread cone holder is adjustable in relation to the thread guide.

4. The apparatus of claim 1 wherein the thread guide includes a thread gate wherein the thread gate includes a pair of horizontal contacts between which the thread from said thread cone holder is directed.

5. The apparatus of claim 1 wherein the thread guide farther includes a pair of vertical contacts between which the thread is directed in an "S" pattern.

6. The apparatus of claim 1 wherein the thread guide includes:

(a) a thread channel into which the thread enters and from which the thread exits such that the thread is aligned with the thread channel as it exits the thread guide and wherein the thread channel moves up and down within the thread guide in response to where the thread is removed from the thread cone holder;

(b) a thread gate wherein the thread gate includes a pair of horizontal contacts between which the thread from said thread holder thread cone holder is directed; and (c) a pair of vertical contacts between which the thread is directed in an "S" pattern.

7. The apparatus of claim 1 further including a stand wherein the stand supports the thread cone holder, the thread guide, and the motor controller and wherein the stand is connected with the machine and wherein the stand includes a power source connected with the motor.

8. The apparatus of claim 1 further including a thread cone containing the thread wherein the thread one is removably connected with ate thread cone holder.

9. A sewing machine thread tension apparatus comprising:

(a) a thread cone holder configured to hold thread connected to a motor;

(b) a thread guide wherein the thread guide includes a thread channel such that the thread guide directs the thread to a sewing machine wherein the sewing machine draws the thread in a first direction and wherein the thread channel includes a vertical channel and a horizontal channel and wherein the thread channel moves up and down within the thread guide in response to where the thread is removed from the thread cone holder; and (c) a motor controller connected with the motor, wherein the motor controller operates the motor to turn the thread cone holder such that the thread is drawn in a second direction opposite from the sewing machine first direction such that tension is applied to the thread as the thread is drawn to the sewing machine and wherein the motor controller operates the motor such that tension on the thread is increased or decreased.

10. The apparatus of claim 9 wherein the thread cone holder adjustable in relation to the thread guide.

11. The apparatus of claim 9 wherein the thread guide includes a thread gate wherein the thread gate includes a pair of horizontal contacts between which the thread from said thread cone holder is directed.

12. The apparatus of claim 9 wherein the thread guide further includes a pair of vertical contacts between which the thread is directed in an "S" pattern.

13. The apparatus of claim 9 wherein the thread guide includes:

(a) a thread channel into which the thread enters and from which the thread exits such that the thread is aligned with the thread channel as it exits the thread guide and wherein the thread channel moves up and down within the thread guide in response to where the thread is removed from the thread cone holder;

(b) a thread gate wherein the thread gate includes a pair of horizontal contacts between which the thread from said thread cone holder is directed; and (c) a pair of vertical contacts between which the thread is directed in an "S" pattern.

14. The apparatus of claim 9 further including a stand wherein the stand supports the thread cone holder, the thread guide, and the motor controller and wherein the stand is connected with the sewing machine and wherein the stand includes a power source connected with the motor.

15. The apparatus of claim 9 further including a thread cone containing the thread wherein the thread cone is removably connected with the thread cone holder.

16. A sewing machine thread tension method comprising:

(a) providing a thread cone holder configured to hold thread wherein the thread cone holder is connected to a motor; a thread guide wherein the thread guide includes a thread channel into which the thread enters and from which the thread exits such that the thread is aligned with the thread channel as it exits the thread guide and wherein the thread channel moves up and down within the thread guide in response to where the thread is removed from the thread cone holder such that the thread guide directs the thread to a sewing machine wherein the sewing machine draws the thread in a first direction; a thread gate wherein the thread gate includes a pair of horizontal contacts between which the thread from said thread cone holder is directed and a pair of vertical contacts between which the thread is directed in an "S" pattern; and a motor controller connected with the motor, wherein the motor controller operates the motor to turn the thread cone holder such that the thread is drawn in a second direction opposite from the sewing machine first direction such that tension is applied to the thread as the thread is drawn to the sewing machine; and (b) connecting the thread from the thread cone holder to the thread guide in the thread channel.

17. The method of claim 16 wherein the motor controller operates the motor such that tension on the thread is increased or decreased.

18. The method of claim 16 further including a thread cone containing the thread wherein the thread cone is removably connected with the thread cone holder.

19. The method of claim 16 wherein the thread cone holder is adjustable in relation to the thread guide.

20. The method of claim 16 further including a stand wherein the stand supports the thread cone holder, the thread guide, and the motor controller and wherein the stand is connected with the sewing machine and wherein the stand includes a power source connected with the motor.

* * * * *